US008113797B2

(12) United States Patent
Valbjoern et al.

(10) Patent No.: US 8,113,797 B2
(45) Date of Patent: Feb. 14, 2012

(54) HERMETICALLY ENCLOSED REFRIGERANT COMPRESSOR ARRANGEMENT

(75) Inventors: Jesper Valbjoern, Kolding (DK); Kristoffer Riemann Hansen, Broager (DK); Anders Jakob Madsen, Nordborg (DK)

(73) Assignee: Secop GmbH, Flensburg (DE)

( * ) Notice: Subject to any disclaimer, the term of this patent is extended or adjusted under 35 U.S.C. 154(b) by 744 days.

(21) Appl. No.: 12/186,037

(22) Filed: Aug. 5, 2008

(65) Prior Publication Data

US 2009/0068030 A1 Mar. 12, 2009

(30) Foreign Application Priority Data

Aug. 16, 2007 (DE) ..... 10 2007 038 443

(51) Int. Cl.
*F04B 35/04* (2006.01)

(52) U.S. Cl. ..... 417/363; 310/216.115; 310/71; 310/215; 417/415; 417/902

(58) Field of Classification Search ..... 417/363, 417/415, 572, 902; 248/623, 624; 310/216.115, 310/71, 215

See application file for complete search history.

(56) References Cited

U.S. PATENT DOCUMENTS 3,882,336 A * 5/1975 Boyd et al. ..... 310/216.115
4,118,153 A * 10/1978 Stannow et al. ..... 417/363
4,427,349 A * 1/1984 Elson ..... 417/363
4,871,300 A 10/1989 Outzen
5,435,702 A 7/1995 Koyama et al.
5,934,884 A 8/1999 Son
6,171,077 B1 * 1/2001 Calciolari et al. ..... 417/363
6,435,841 B1 * 8/2002 Kim ..... 417/363
6,589,029 B1 * 7/2003 Heller ..... 417/415
6,641,374 B2 * 11/2003 Kim ..... 417/312

FOREIGN PATENT DOCUMENTS

DE 3719436 A1 1/1988
GB 2032004 A * 4/1980

* cited by examiner

*Primary Examiner* — Devon C Kramer

*Assistant Examiner* — Ryan Gatzemeyer

(74) *Attorney, Agent, or Firm* — McCormick, Paulding & Huber LLP

(57) ABSTRACT

Provided is a simplified design for spring retainers in a hermetically enclosed refrigerant compressor. A hermetically enclosed refrigerant compressor includes a hermetically tight enclosure, and an electrical motor unit and a compressor supported relative to the enclosure by springs. The electrical motor unit and compressor include a first spring retainer and the enclosure includes a second spring retainer. The first and second spring retainers hold springs such that the electrical motor and compressor are supported relative to the enclosure. The first spring retainer is integrated with the electrical motor unit and the compressor.

14 Claims, 3 Drawing Sheets

HERMETICALLY ENCLOSED REFRIGERANT COMPRESSOR ARRANGEMENT

CROSS REFERENCE TO RELATED APPLICATIONS

Applicant hereby claims foreign priority benefits under U.S.C. §119 from German Patent Application No. 10 2007 038 443.4 filed on Aug. 16, 2007, the contents of which are incorporated by reference herein.

FIELD OF THE INVENTION

The invention concerns a hermetically enclosed refrigerant compressor arrangement having a hermetically tight enclosure, a unit comprising an electrical motor with stator and rotor and a compressor with cylinder head cover, and springs fixed on the unit via first spring retainers and on the enclosure via second spring retainers.

BACKGROUND OF THE INVENTION

Such a refrigerant compressor arrangement is known from DE 26 17 369 A1. The springs are made to be helical springs, which are located between the stator and the bottom of the enclosure. The stator-side first spring retainers are fitted on the heads of screws holding the stator core lamination together. The second spring retainers connected to the bottom of the enclosure are welded onto the enclosure.

U.S. Pat. No. 5,435,702 shows a compressor, in which the first spring retainers are screwed onto the stator by means of mounting fittings projecting laterally over the stator. The mounting fittings permit an expansion of the base surface, as the spring retainers can engage outside the outer edges of the stator.

DE 37 26 758 C2 shows a spring support of a compressor, in which the two kinds of spring retainers are made by means of deep-drawing of plate parts.

DE 37 19 436 A1 shows a hermetic refrigerant compressor, in which at least three support springs are provided, whose longitudinal axes are inclined in relation to the axis of the drive shaft, and which are located in different horizontal levels. Further to spring retainers on the stator, at least one spring retainer is formed in the suction arrangement of the compressor.

SUMMARY OF THE INVENTION

The invention is based on the task of simplifying the design of the spring mounting.

With a refrigerant compressor arrangement as mentioned in the introduction, this task is solved in that at least one of the elements cylinder head cover and end plate of the stator comprises at least one integrated first spring retainer.

Thus, it is possible, particularly in connection with small compressors, whose low refrigeration output only requires a small drive motor, to realise a relatively simply designed spring retainer, in which no additional threaded bores, screws, mounting fittings or the like are required. On the contrary, the spring retainers are integrated in the cylinder head cover and/or the end plate, that is, they are made in one piece with the cylinder head cover and/or the end plate of the stator, or they can be formed in these units already during manufacturing. During handling of the unit when assembling the compressor, no additional elements have to be handled to form the retainers for the springs.

Preferably, the bottom sides of the cylinder head cover and the end plate are located in the same horizontal level. When, in the following, the terms "horizontal" and "vertical" or "top" and "bottom" are used, they refer to the application related mounting position of the refrigerant compressor arrangement in a refrigeration appliance, for example a refrigerator or a freezer. When the bottom sides are located in the same horizontal level, a horizontal support of the unit is possible, so that a lateral force can only act upon the springs with little effect.

Preferably, all springs are located in the same horizontal level. Thus, not only the first spring retainers, but also the second spring retainers, are located in the same horizontal level. This enables a very stable operation of the arrangement.

Preferably, the stator has a stator core lamination, in which grooves are provided, the end plate engaging said grooves. The fact that the electrically isolating end plate engages the grooves means that it does not only isolate the stator core lamination from the electrical winding, which is located in the grooves. It also provides a form-fitting connection between the end plate and the stator core lamination, which prevents a lateral displacement of the end plate and the stator core lamination in relation to each other. Thus, the remaining forces used to connect the end plate and the stator core lamination to each other can be kept small, so that the end plate does not have to be dimensioned to be excessively strong.

Preferably, between the grooves the stator core lamination has webs, one front side of each web being covered by the end plate. Also this measure has two effects. Firstly, the end plate, which is made from an electrically isolating material, also isolates the coils from the stator core lamination in the area of the coil head. Secondly, the coils are used for further fixing the end plate to the stator core lamination. Also when the fixing forces acting upon the end plate from the winding are not excessively large, they contribute to the exact positioning of the end plate on the stator, so that an exact alignment between the spring or springs and the stator is ensured, also when the springs are not fixed directly on the stator core lamination, but on the end plate.

Preferably, the end plate is made as a plastic injection moulded part. With an injection moulded part it is possible, practically without additional costs, to integrate the first spring retainers. They are made in one piece with the end plate and are generated by using a corresponding injection mould.

Preferably, the end plate is made as a plastic injection molded part. With an injection molded part it is possible, practically without additional costs, to integrate the first spring retainers. They are made in one piece with the end plate and are generated by using a corresponding injection mold.

Preferably, the cylinder head cover is made as a pressure or injection molded part of aluminum. Also here, the first spring retainer can be formed on or in the part without problems, that is, additional working steps are not required to connect the first spring retainer to the cylinder head cover.

Preferably, the reinforcement brace is located in extension of a first spring retainer. In a manner of speaking, it can thus straight away adopt the forces acting upon the cylinder head cover from the spring.

Advantageously, a safety element is located on the inside of the enclosure facing away from the springs, said safety element engaging an opening of a safety ring located on the unit. The safety ring does not have to be circular. It is also possible to make a circular opening in an otherwise square ring, so that the safety ring has the shape of a plate with an opening. The interaction between the safety element and the safety ring then forms a securing device, that is, it is prevented that, for example during transport, the unit strikes against the enclosure, thus causing undue deformations.

Preferably, the safety element and/or the safety ring have a flexible coating. This coating can, for example, be made of a plastic or a rubber. The flexibility prevents the safety ring from hitting hardly on the safety element.

Preferably, the motor has a drive shaft, whose lower end is guided through an opening in a safety plate, which is fixed on the inside of the enclosure. Also this is an additional securing device. In relation to the enclosure, the motor can only move as far as the lower end of the drive shaft can move in the opening of the safety plate.

Preferably, at least one end of at least one spring has a retaining insert, with which it is fitted on its spring retainer. This gives the opportunity of providing the same spring retainers with springs of different shapes and sizes. This enables a cost-effective manufacturing, as one single kind of cylinder head cover and/or end plate can be used for a number of compressor units.

Preferably, the springs are located under the unit. Thus, they extend substantially in parallel to the drive shaft axis. This enables a very compact design of the refrigerant compressor arrangement.

BRIEF DESCRIPTION OF THE DRAWINGS

In the following, a preferred embodiment is described in connection with the drawings, showing.

DETAILED DESCRIPTION

Figure 1:
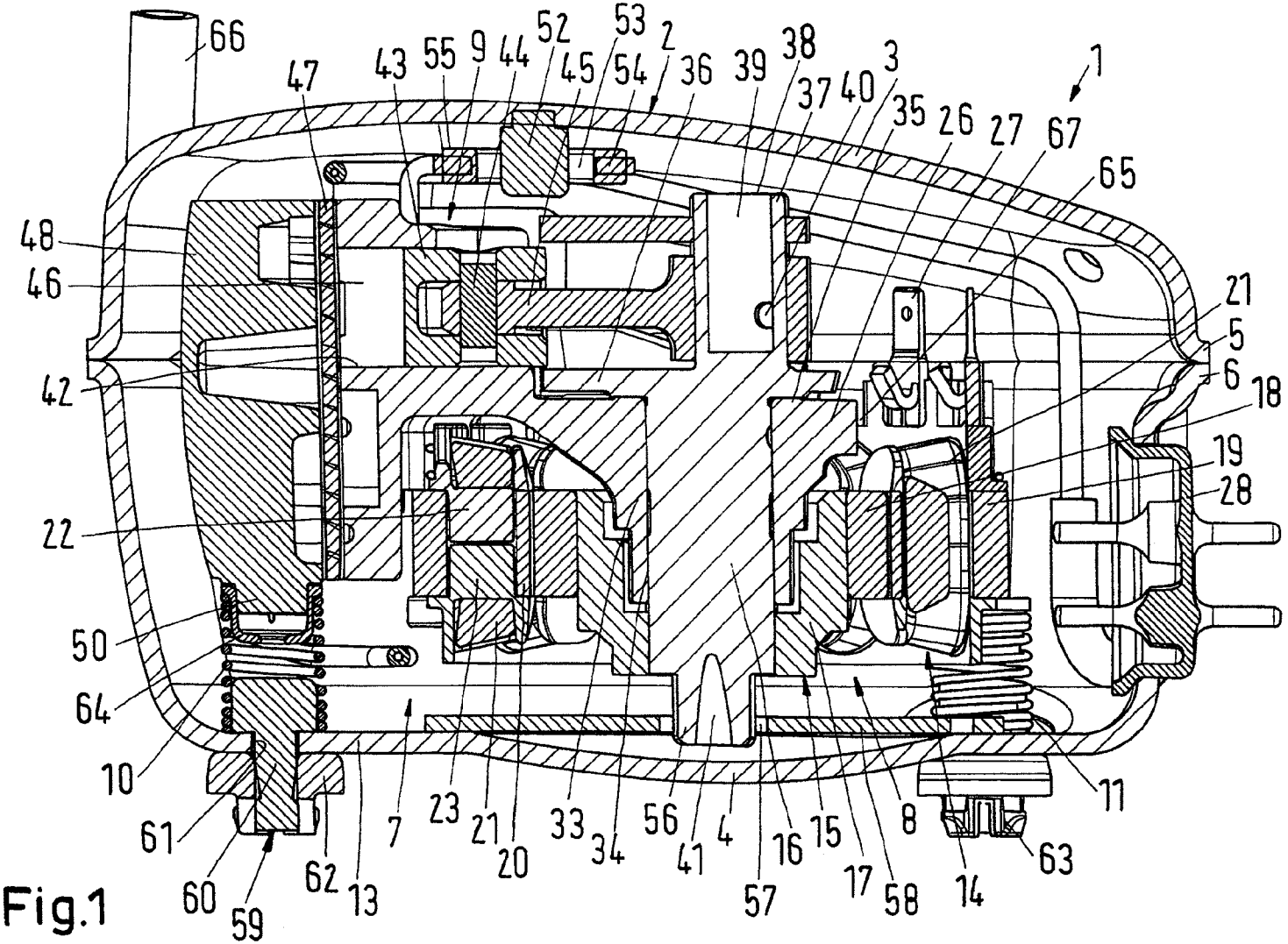
FIG. 1 a longitudinal section through a refrigerant compressor arrangement.
Figure 2:
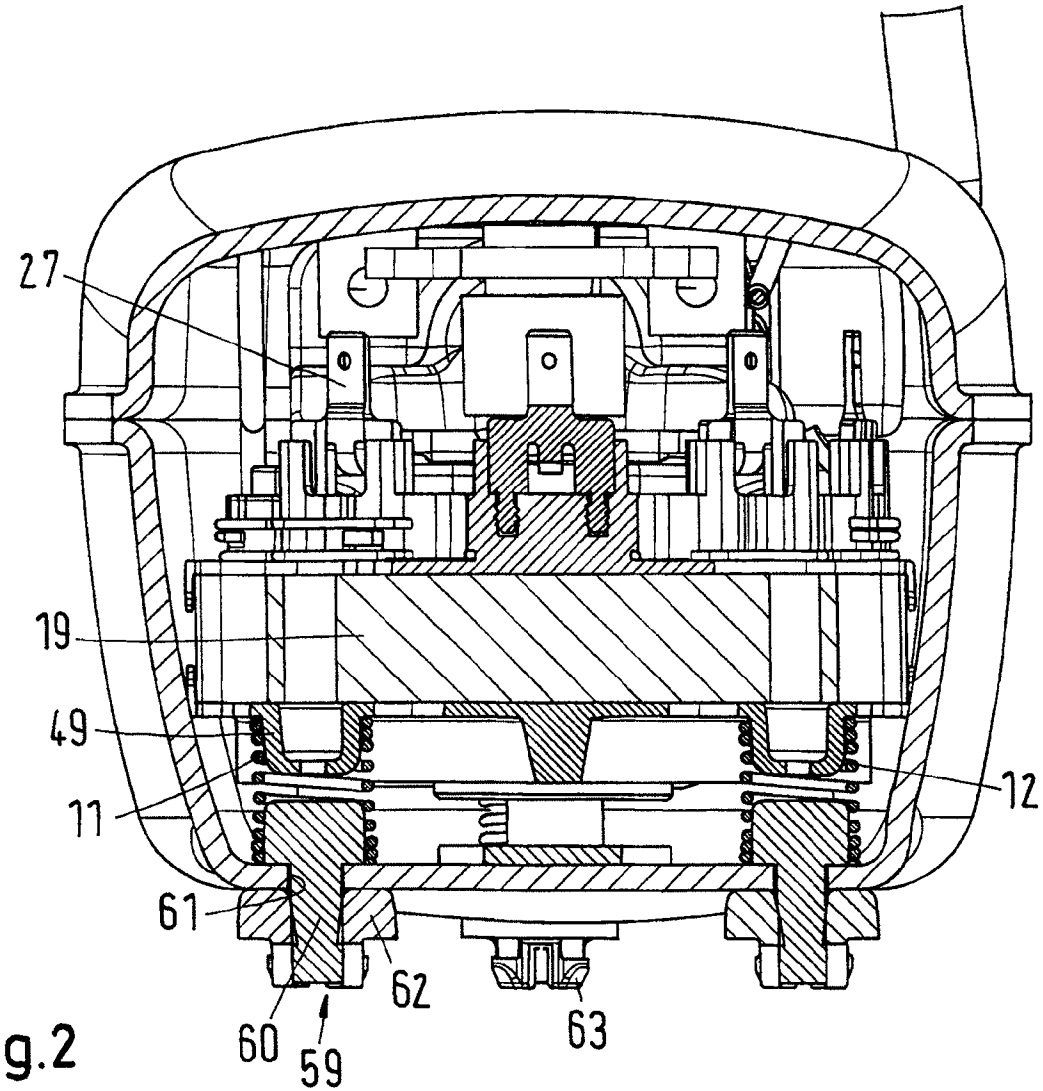
FIG. 2 a cross-section through the arrangement of FIG. 1

FIG. 1 shows a refrigerant compressor arrangement 1 with a hermetically tight, closed enclosure 2 comprising an upper part 3 and a lower part 4. The upper part 3 has a flange 5. The lower part 4 has a flange 6. Along the flanges 5, 6 the upper part 3 and the lower part 4 are connected to each other, for example by means of welding.

The refrigerant compressor arrangement 1 has a unit 7 with an electric motor 8 and a compressor 9. Via several springs 10-12, the unit 7 is supported on the lower part 4 of the enclosure 2, or rather on its bottom 13. Here, the springs 10-12 are made as helical springs.

The motor 8 has a stator 14 and a rotor 15. The rotor is unrotatably connected to a crank shaft 16, for example by shrinking or pressing, and rotates inside a central opening of the stator 14. The rotor 15 has a support part 17, which can be made of metal and have permanent magnets 18 located on its radial outside. These magnets are fixed on the support part 17 by suitable means, for example adhesives or special clamps.

Figure 3:
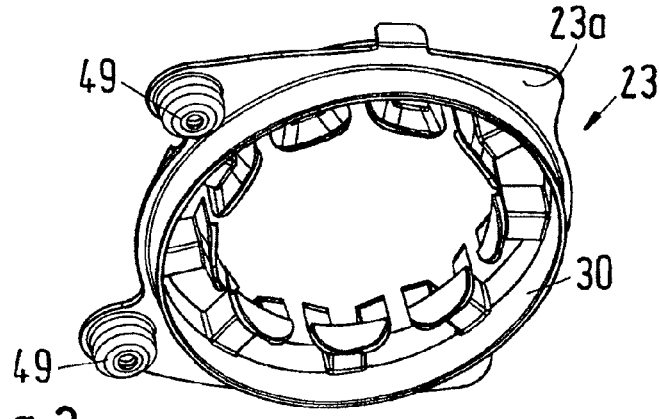
FIG. 3 a perspective view of the lower end plate
Figure 4:
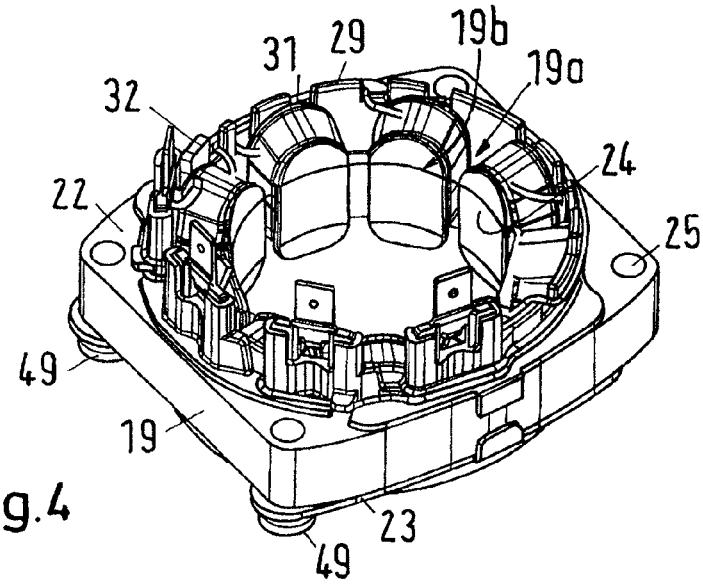
FIG. 4 a stator of the motor
Figure 5:
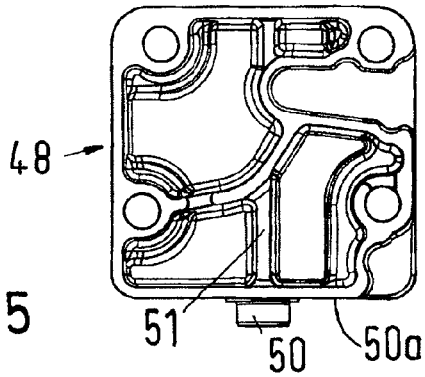
FIG. 5 a top view of the inside of the cylinder head cover.

The stator 14 has a stator core lamination 19 having several pole teeth 20 on its radial inside, said pole teeth 20 being formed by webs and salient poles on the inside of the stator opening. In the grooves 19*a* (FIG. 3) formed between the pole teeth 20, windings 21 are located, each surrounding a web.

Between the stator core lamination 19 and the windings 21 is located an electrical isolation in the form of an upper end plate 22 and a lower end plate 23. Each end plate 22, 23 completely covers an axial end face of the stator core lamination 19 and the axial surfaces of the pole teeth, except for the radial inner pole faces 24. The two end plates 22, 23 touch each other in the grooves 19*a*, or are at least very close to each other there. Thus, the two end plates 22, 23 form a complete electrical isolation between the windings 21 and the stator core lamination 19.

The fact that the end plates 22, 23 are made to be three-dimensional causes that they do not only bear evenly on the front side of the stator core lamination 19, but also engage the stator core lamination 19, so that, in a manner of speaking, they are held at the stator core lamination 19 in a form-fitting manner. The stator core lamination 19 and the end plates 22, 23 have through bores 25, through which fixing bolts can be guided. Firstly, these fixing bolts keep the stator core lamination 19 axially together. Secondly they serve the purpose of connecting the stator 14 of the motor 8 to a compressor block 26, which will be described below. The fact that due to their three-dimensional design the end plates 22, 23 are to a great extent secured against a displacement in relation to the stator core lamination 19, causes that the forces required for the tightening can be kept small, so that the mechanical strain on the end plates 22, 23 will not be excessively large.

The upper end plate 22 has electrical connections 27, through which the motor 8 can be connected to an energy source. The connection is realised by means of cables, not shown in detail, which extend between the electrical connections 27 and a connection arrangement 28 inserted in a sealing manner in the enclosure.

The two end plates 22, 23 have circumferential projections 29, 30, respectively. The circumferential projection 29 of the upper end plate 22 has several interruptions 31, through which electrical cables or winding wires 32 can be guided.

The compressor block 26 has an extension 33 in the direction of the bottom 13, the extension 33 extending through the stator 14 of the motor. Only windings 21 further extend over the extension 33 in the axial direction. The extension 33 forms a radial bearing 34. At the upper side of the extension in the compressor block 26 is formed an axial bearing 35, on which the crank shaft 16 bears with a plate 36, the plate 36 carrying a crank pin 37 located eccentrically to the axis of the crank shaft 16. At the end facing the upper part 3 the crank pin 37 has an opening 38 of an oil reservoir 39 that is supplied by an oil pump 41 via a pipe, which is not shown in detail, the pump 41 only being partly visible in FIG. 1. When the crank shaft rotates, oil from the oil reservoir 39 is sprayed inside the enclosure 2 via the opening 38.

The stator 14 has a stator core lamination 19 having several pole teeth 20 on its radial inside, said pole teeth 20 being formed by webs 19*b* and salient poles on the inside of the stator opening. In the grooves 19*a* (FIG. 3) formed between the pole teeth 20, windings 21 are located, each surrounding a web.

The pressure chamber 46 is additionally bordered by a valve plate 47, which is fitted on the compressor block 26. In a manner known per se, the valve plate 47 has at least one inlet valve and at least one outlet valve to control the suction and the discharge process of refrigerant. On the side facing away from the compressor block 26 a cylinder head cover 48 bears on the valve plate 47, the cylinder head cover 48 comprising suction and pressure chambers and a chamber for a muffler.

The lower end plate 23 comprises two first spring retainers 49, on which the springs 11, 12 are mounted. The cylinder head cover 48 also comprises a first spring retainer 5*o*, on which the spring 10 is mounted. "First spring retainers" are the spring retainers allocated to the unit 7.

The lower end plate 23 is made as an injection moulded part of plastic. When making such an injection moulded part, it is possible without problems to make the first spring retainers 49 in one piece with the lower end plate 23 without causing additional costs. This saves a further mounting step, during which the first spring retainers 49 are connected to the motor 8.

The cylinder head cover 48 is made of aluminum and is made in a pressure molding or injection molding process. Accordingly, it is also here possible to make the first spring retainer 50 in one piece with the cylinder head cover 48 without causing additional costs. The connection between the first spring retainer 50 and the cylinder head cover 48 is extremely stable.

However, not in all cases the cylinder head cover 48 has sufficient mechanical load capacity to adopt the forces corresponding to the weight force of the unit 7. For this reason, the inside, that is, the side facing the valve plate 47, of the cylinder head cover 48 is provided with a reinforcement brace 51, which is located in extension of the spring 10, so that forces from the spring 10 acting upon the cylinder head cover 48 can also be adopted by the reinforcement brace 51.

The first spring retainers 49, 50 on the lower end plate 23 and the cylinder head cover 48 are in the same horizontal level, so that upwards the springs 10-12 also end in the same horizontal level. Also at the bottom 13 of the enclosure 2 the springs 10-12 are supported in the same horizontal level, so that they are practically only loaded by weight forces in the gravity direction. Thus, only during transport larger lateral deflections are a risk. During operation imbalances and the like may cause small lateral deflections of the springs 10-12.

The inside of the upper part 3 is provided with a safety element 52, which extends into an opening 53 in a safety ring 54. The safety ring 54 has a deformable coating 55, for example made of a plastic or a rubber. The safety element 52 is, for example, cylinder shaped. In this case, the opening 53 is circular. In relation to the enclosure 2, the unit 7 can only move, until the safety ring 54 comes to rest on the safety element 52. Thus, a deformation of the enclosure 2 is avoided. The coating 55 serves the purpose of keeping noises small, which could arise when the safety ring 54 comes to rest on the safety element 52. Alternatively or additionally, of course also the safety element 52 can be provided with a corresponding damping coating.

At its lower end, the crank shaft 16 has an extension 56, which extends through an opening 57 in a plate 58, which is fixedly connected to the bottom 13 of the lower part 4, for example by welding. Also this forms a securing device. The unit 7 can only move in relation to the lower part 4 until the extension 56 comes to rest on the plate 58.

In the bottom 13 of the lower part 4 second spring retainers 59 are located, on which the springs 10-12 are mounted. The second spring retainers 59 comprise substantially cylindrical sections 60, each extending through an opening 61 in the bottom 13. This section 60 can be used for mounting the arrangement 1 on a base, for example a bottom plate of a refrigeration appliance. The section 60 is connected to the enclosure 2 in a hermetically tight manner. An elastic element serves as vibration suppression between the arrangement 1 and the base. At the lower end of the section 60 elastic tongues 63 are provided, with which the arrangement 1 can engage in openings of a bottom plate.

The lower end plate 23 is made as an injection molded part of plastic. When making such an injection molded part, it is possible without problems to make the first spring retainers 49 in one piece with the lower end plate 23 without causing additional costs. This saves a further mounting step, during which the first spring retainers 49 are connected to the motor 8.

The cylinder head cover 48 is made of aluminum and is made in a pressure molding or injection molding process. Accordingly, it is also here possible to make the first spring retainer 50 in one piece with the cylinder head cover 48 without causing additional costs. The connection between the first spring retainer 50 and the cylinder head cover 48 is extremely stable.

The fact that the motor 8 is a permanent magnet energized synchronous motor with inner rotor, the rotor 15 having several permanent magnets 18 distributed on its outer circumferential face, permits the motor 8 to be made with a comparatively small height. This keeps the height of the arrangement 1 small.

Preferably, the bottom side 50*a* of the cylinder head cover 48 and the bottom side 23*a* of the end plate 23 are located in the same horizontal level. The first spring retainers 49, 50 on the lower end plate 23 and the cylinder head cover 48 are in the same horizontal level, so that upwards the springs 10-12 also end in the same horizontal level. Also at the bottom 13 of the enclosure 2 the springs 10-12 are supported in the same horizontal level, so that they are practically only loaded by weight forces in the gravity direction. Thus, only during transport larger lateral deflections are a risk. During operation imbalances and the like may cause small lateral deflections of the springs 10-12.

The refrigerant compressor arrangement 1 works so that refrigerant gas is sucked into the enclosure 2 via a suction connector 66. After compression in the pressure chamber 26 the refrigerant gas is discharged from the enclosure 2 through a pressure connector 67. The control of the refrigerant gas takes place via the valve plate 47.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A hermetically enclosed refrigerant compressor arrangement comprising:

a hermetically tight enclosure;

a unit comprising an electrical motor, the electrical motor comprising a stator with a stator core lamination, a stator winding, and an electrically insulating end plate disposed between the stator core lamination and the stator winding;

a compressor with a cylinder head cover; and springs fixed on the unit via first spring retainers and on the enclosure via second spring retainers;

wherein each of the cylinder head cover and the end plate of the stator comprises at least one integrated first spring retainer.

2. The arrangement according to claim 1, wherein the cylinder head cover and the end plate have bottom sides, which are located in the same horizontal level.

3. The arrangement according to claim 2, wherein all springs are located in the same horizontal level.

4. The arrangement according to claim 1, wherein the stator has a stator core lamination, in which grooves are provided, the end plate engaging said grooves.

5. The arrangement according to claim 4, wherein between the grooves the stator core lamination has webs, one front side of each web being covered by the end plate.

6. The arrangement according to claim 1, wherein the end plate is made as a plastic injection molded part.

7. The arrangement according to claim 1, wherein the cylinder head cover is made as a pressure or injection molded part of aluminum.

8. The arrangement according to claim 1, wherein the cylinder head cover has a reinforcement brace.

9. The arrangement according to claim 8, wherein the reinforcement brace is located in extension of a first spring retainer.

10. The arrangement according to claim 1, wherein a safety element is located on the inside of the enclosure facing away from the springs, said safety element engaging an opening of a safety ring located on the unit.

11. The arrangement according to claim 10, wherein the safety element and/or the safety ring has a flexible coating.

12. The arrangement according to claim 1, wherein the motor has a drive shaft, whose lower end is guided through an opening in a safety plate, which is fixed on the inside of the enclosure.

13. The arrangement according to claim 1, wherein at least one end of at least one spring has a retaining insert, with which it is fitted on its spring retainer.

14. The arrangement according to claim 1, wherein the springs are located under the unit.

* * * * *